United States Patent [19]

Hendricksen

[11] Patent Number: 4,961,068

[45] Date of Patent: Oct. 2, 1990

[54] DOMESTIC SEWER ALARM

[76] Inventor: Curtis C. Hendricksen, 54 Van Buren Rd., Limestone, Me. 04750

[21] Appl. No.: 295,532

[22] Filed: Jan. 11, 1989

[51] Int. Cl.[5] ..... G08B 21/00

[52] U.S. Cl. ..... 340/616; 340/620; 340/625; 340/608

[58] Field of Search ..... 340/616, 620, 625, 608; 137/582

[56] References Cited

U.S. PATENT DOCUMENTS

| | | | |
|---|---|---|---|
| 2,761,037 | 8/1956 | Thomas | 340/608 |
| 3,202,165 | 8/1965 | Yanicoli | 137/411 |
| 3,757,316 | 9/1973 | Fiorenzo | 340/620 |
| 3,774,187 | 11/1973 | Windham | 340/608 |
| 3,834,415 | 9/1974 | Herron | 137/411 |
| 3,978,462 | 8/1976 | Goodman | 340/608 |
| 4,091,365 | 5/1978 | Allen | 340/625 |
| 4,392,128 | 7/1983 | Young | 340/620 |
| 4,398,186 | 8/1983 | Statz | 340/616 |
| 4,546,346 | 8/1985 | Wave | 340/616 |

*Primary Examiner*—Joseph A. Orsino
*Assistant Examiner*—Kinfe-Michael Negash
*Attorney, Agent, or Firm*—Fleit, Jacobson, Cohn, Price, Holman & Stern

[57] ABSTRACT

A pair of float operated sensors simultaneously detect inflow into the housing of an alarm assembly to actuate a buzzer and a lamp providing an early warning back-up alarm. One of the sensors remains actuated by the holding action of a magnet to continue operation signifying back-up recession. Under selective control, the buzzer is operated in by-pass relation to the sensors to indicate a low voltage condition of the battery powering the alarm assembly.

23 Claims, 3 Drawing Sheets

DOMESTIC SEWER ALARM

BACKGROUND OF THE INVENTION

1. Field of the Invention

This invention relates generally to a sewer back-up alarm system and more particularly to an early warning system that is triggered into operation before any serious back-up problem occurs.

The use of sewer back-up alarm devices in the clean-out opening portion of a conduit associated with a gravity fed sewer system, is generally well known. Such a sewer back-up alarm device, powered from a 110 volt electrical power supply rather than a battery is disclosed by way of example in U.S. Pat. No. 3,757,316 to Fiorenzo. The sewer back-up alarm device replaces the clean-out opening cap in a sewer outlet conduit in order to detect sewer back-up by means of a sensor. The Fiorenzo patent as well as U.S. Pat. Nos. 3,202,165 and 4,398,186 to Yavicoli and Statz, respectively, teach the use of float operated sensors for detecting the presence of the fluent back-up material in systems which are also powered by 110 volt electrical power supplies. Energization of a lamp indicator under control of the float operated sensor in a sewer back-up alarm system and the extinction of the lamp when the back-up recedes, is also disclosed in the Yavicoli patent. Buzzer types of back-up warning devices are furthermore disclosed in the Fiorenzo patent aforementioned as well as in U.S. Pat. Nos. 4,546,346 and 4,392,128 to Wave et al and Young et al, respectively. According to the Wave et al patent, sewer pipe blockage is detected by a pressure responsive sensor through a detention tank in order to trigger a buzzer type alarm through a pneumatic switch. According to the Young et al patent, the buzzer alarm is triggered when back-up overflow occurs. U.S. Pat. No. 4,091,365 to Allen is also of interest in that it discloses a sewer back-up alarm unit replacing the clean-out cap in the clean-out access opening of a sewer system, wherein the sensor arrangement includes a pivotal float arm. A magnet is attached to the float arm in order to operate a proximity switch when the float arm is displaced to an actuating position by the liquid in the sewer.

It is an important object of the present invention to provide a sewer back-up alarm device of the aforementioned type adapted to be installed in the clean-out access opening of a gravity feed sewer conduit in order to provide an early warning alert with respect to sewer back-up in a more reliable manner.

It is a further object in accordance with the foregoing object to provide an early warning alarm for sewer back-up conditions by means of a device that is easily installed, maintained and monitored with respect to its operating condition.

SUMMARY OF THE INVENTION

In accordance with the present invention, an alarm device is provided with an elongated housing extending from a replacement cap for a clean-out access opening of a sewer conduit. An audible alert or buzzer is mounted on the cap as well as a lamp indicator, a reset control and an actuator switch through which alarm signals are provided and alarm operation controlled. The buzzer and indicator lamp are simultaneously energized from an internal battery source to signify the onset of sewer back-up conditions. The indicator lamp is extinguished while the buzzer remains in operation to signify receding of the back-up condition. Buzzer operation may be terminated by switch off or manual actuation of the reset control. The device may also be conditioned through the actuator switch to monitor the voltage level condition of the battery source of power.

The buzzer and indicator lamp are respectively controlled by float operated sensors positioned within the housing to detect inflow of a predetermined volume of back-up material through a screened inlet opening in the housing adjacent a lower axial end thereof. The float operated sensors are protectively isolated from impact by the inflowing back-up material by means of a baffle arrangement. The baffle and the sensor assemblies are operatively positioned within the housing by a spacing support in abutment with a sealing closure for the housing at its lower end through which access to the internal components of the alarm device is provided for cleaning and maintenance purposes. Screened draining outlets are provided on the housing at spaced locations in operative relationship to the baffle and sensor assemblies to ensure prompt draining of back-up material.

One of the float operated sensor devices responds to both inflow of back-up material and draining thereof to control illumination and extinction of the indicator lamp. The other float operated sensor device, when actuated in response to detection of fluent material, triggers operation of the buzzer and is held in its actuated position by a magnet in order to maintain buzzer operation until the sensor device is reset by the manually operable reset control aforementioned.

Operation of the buzzer is terminated by the reset control through an internal switch displaced to an open position at the same time that the float operated sensor device is displaced from its actuated position. The buzzer is conditioned for signaling a low battery voltage condition by displacement of the aforementioned actuator switch which is operative through a relay to de-energize the buzzer. A relay switch associated with the relay is maintained open by a relay coil energized by the battery source through an adjustable resistor. When the battery voltage drops below a predetermined level, the relay switch closes in order to trigger operation of the buzzer in bypass relation to the sensor devices and thereby signify a low battery voltage condition.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING FIGURES

DETAILED DESCRIPTION OF THE PREFERRED EMBODIMENT

Figure 10:
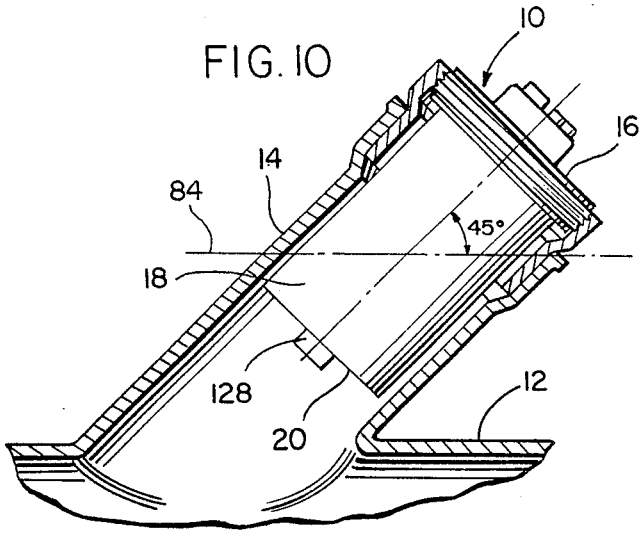
FIG. 10 is a side section view through a typical installation within which the alarm assembly of the present invention is installed.

Referring now to the drawings in detail, FIG. 10 illustrates a typical installation of the sewer back-up alarm assembly of the present invention generally referred to by reference numeral 10. As shown, the alarm assembly 10 is associated with a sewer conduit 12 having a clean-out opening pipe section 14 extending therefrom generally at a 45° angle. The usual clean-out access cap closing the upper end of the clean-out opening section 14, is replaced by an externally threaded cap portion 16 of the alarm assembly 10, having an elongated housing 18 extending from the cap portion 16 into the clean-out opening section 14. The lower end of the housing 18 is sealed by a closure 20.

Figure 1:
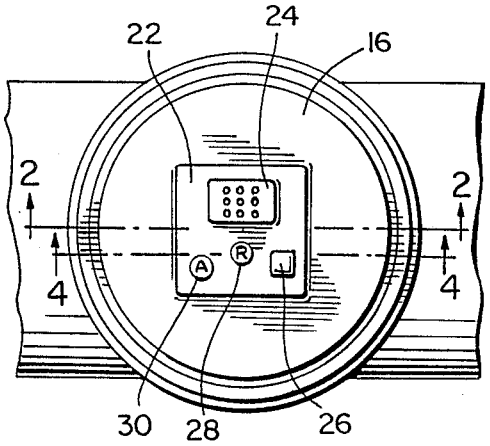
FIG. 1 is a top plan view of an alarm assembly constructed in accordance with one embodiment of the invention.

In accordance with one embodiment of the invention as shown in FIG. 1, the cap portion 16 of the alarm assembly has an externally exposed formation 22 mounting a pair of alarm alerting devices in the form of an audible alerting buzzer 24 and an indicator lamp 26. Also mounted on and exposed adjacent to the alerting devices on formation 22, is a reset control button 28 and an actuator switch 30. The actuator switch 30, the buzzer 24 and the indicator lamp 26 are wired into a control system enclosed within the upper end of the housing 18.

Figure 2:
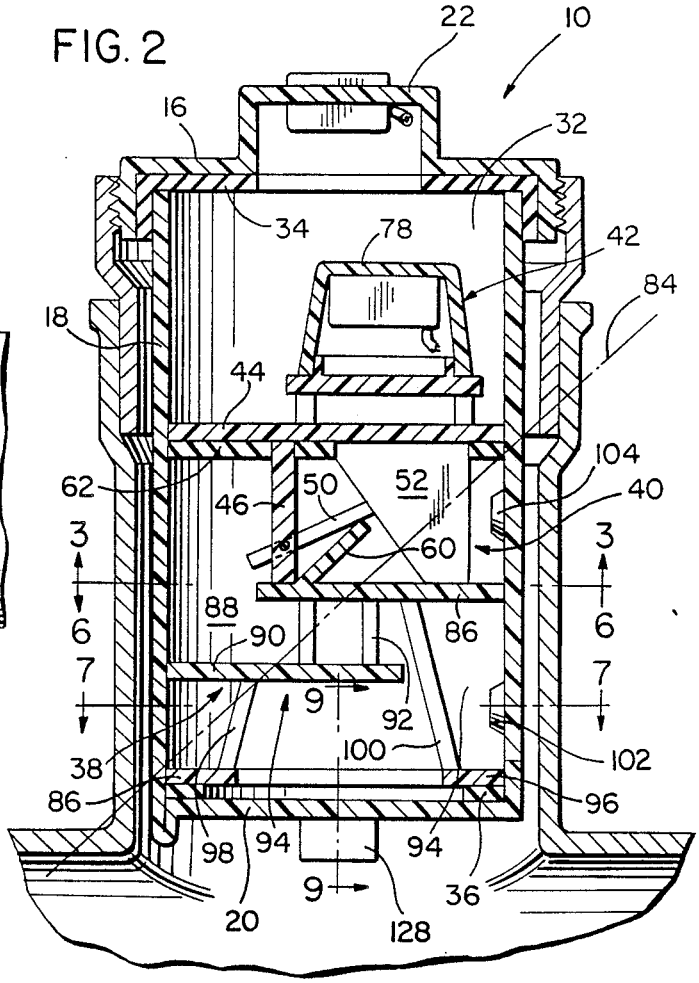
FIG. 2 is a side section view taken substantially through a plane indicated by section line 2—2 in FIG. 1.
Figure 3:
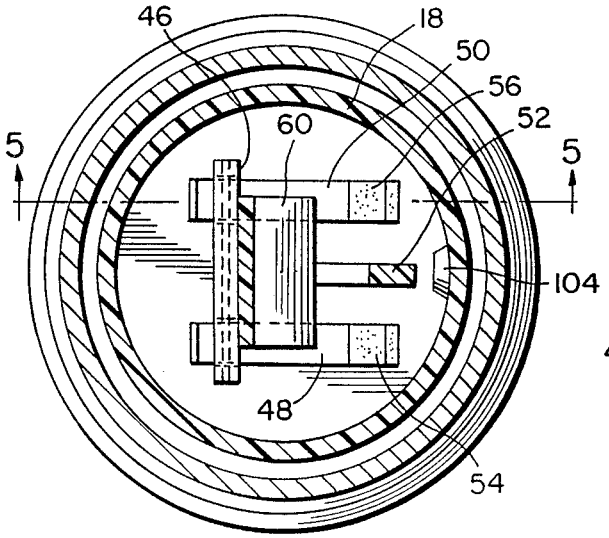
FIG. 3 is a transverse section view taken substantially through a plane indicated, by section line 3—3 in FIG. 2.

As shown in FIG. 2, the housing 18 encloses an axially elongated chamber 32 extending between the cap portion 16 at one axial end and the closure 20 at the other axial end. Annular, flexible sealing elements 34 and 36 are respectively positioned on the cap portion 16 and closure 20 for sealing engagement with the axial ends of the housing. A baffle assembly generally referred to by reference numeral 38 is positioned within the housing chamber 32 in spaced relationship to the closure 20 and in abutment with a sensor assembly generally referred to by reference numeral 40. Attached to the upper end of the sensor assembly 40 within the housing is a protectively enclosed battery power source generally referred to by reference numeral 42. The battery source 42 is wired into the control system with which the sensor assembly 40, the buzzer 24 and lamp 26, the actuator switch 30 and reset control 28 are associated as will be explained hereinafter in detail.

As more clearly seen in FIGS. 2, 3, 4 and 8, the sensor assembly 40 is suspended from a mounting disk 44 above which the battery power source 42 is located within the housing. A support 46 projects downwardly from the mounting disk 44 to pivotally mount a pair of float operated sensor arms 48 and 50 of similar construction on either side of a partition element 52 isolating the float elements 54 and 56 from each other. The float elements are respectively mounted on the ends of the sensor arms 48 and 50 remote from pivot elements 58 by means of which the float operated sensor arms are pivotally mounted on the support 46 as more clearly seen in FIG. 8. The float operated arms 48 and 50 are normally held in a lower limit position under the bias of gravity by a limit element stop 60 extending at an angle from the support structure 46. As will become apparent hereinafter, the sensor arms 48 and 50 are operative to detect the presence of fluent material backed up into the access opening section 14 from the sewer conduit 12. Such back-up fluent material is confined to the housing chamber 32 below the mounting disk 44 in order to protect the alarm system wiring located thereabove within the housing chamber. Toward that end, a sealing element 62 is positioned on the mounting disk in underlying relation thereto as more clearly seen in FIG. 2.

Figure 4:
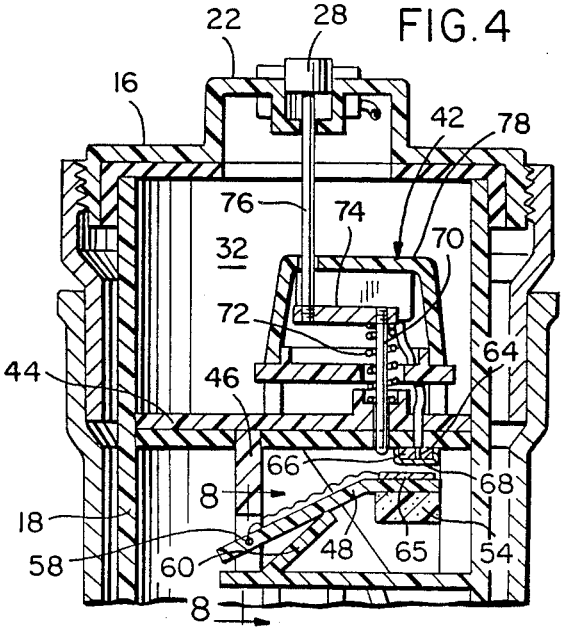
FIG. 4 is a partial side section view taken substantially through a plane indicated by section line 4—4 in FIG. 1.

As shown in FIG. 4, the sensor arm 48 in its limit position is spaced from the contact end of an electrode 64 with which the sensor arm 48 makes contact through a plate 65 thereon when displaced from its limit position by buoyancy forces exerted on the float element 54. The sensor arm 48 is made of a non-conductive material and mounts the plate 65 made of an alloy metal electrically connected to the buzzer 24 and lamp 26 through conductors extending to the pivot 58. A permanent magnet element 66 is associated with the contact probe 64 mounted on the underside of disk 44. The element 66 has a coating 68 thereon of the same metal alloy as plate 65 on sensor arm 48 engageable therewith. Thus, a limited holding zone is established by the magnetic field of the magnet 66 for holding the sensor arm 48 in its actuated position engaging the probe 64 connected by conductor 69 extending through disk 44 to the battery power source 42. The electrically conductive path thereby established to the power source by the sensor arm 48 when actuated, is maintained until it is displaced toward its limit position out of the influence of the limited magnetic holding zone associated with the magnet 66. Such displacement of the sensor arm 48 from its actuated position is effected by axial displacement of a reset rod 70 against the bias of a spring 72 as shown by way of example in FIG. 4. The reset rod 70 is connected through a connector 74 in offset relation to the actuator rod 76 associated with the reset control 28 aforementioned. Displacement of the reset rod 70 against the bias of spring 72 will be limited by abutment of the connector 74 with the housing 78 associated with the power source 42 in order to avoid excessive displacement of the sensor arm 48 and rupture of the limit stop element 60.

Figure 5:
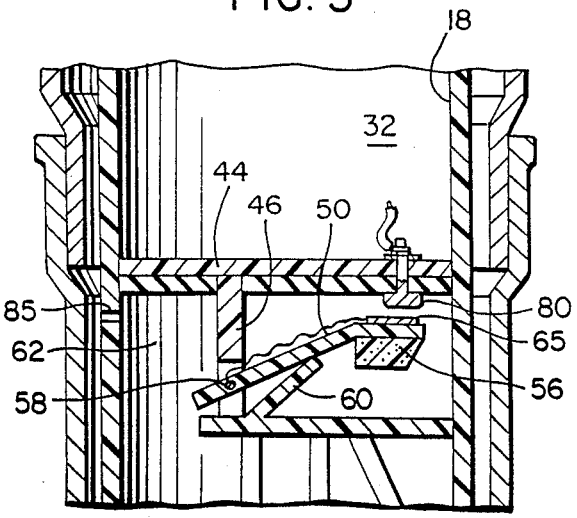
FIG. 5 is a partial section view taken substantially through a plane indicated by section line 5—5 in FIG. 3.

While the sensor arm 48 is maintained in its actuated position by the magnetic holding action of magnet 66 as aforementioned, the other sensor arm 50 when actuated by the buoyant force of the fluent material being detected, will return immediately toward its limit position in response to the receding of the fluent material within the clean-out section 14. In its actuated position, the sensor arm 50 makes contact with a conductive probe element 80 as shown in FIG. 5 in order to establish an electrically conductive path therethrough independently of the electrically conductive path established through the sensor arm 48 as aforementioned. Such independence between the circuit establishing actions of the sensor arms 48 and 50 is ensured by the partition 52 separating the two sensor arms.

Figure 7:
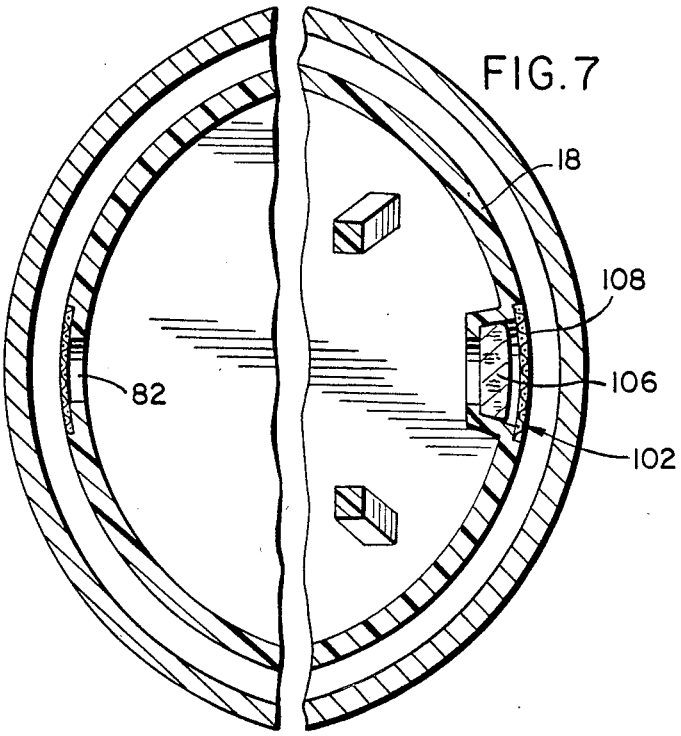
FIG. 7 is a partial section view taken substantially through a plane indicated by section line 7—7 in FIG. 2.
Figure 8:
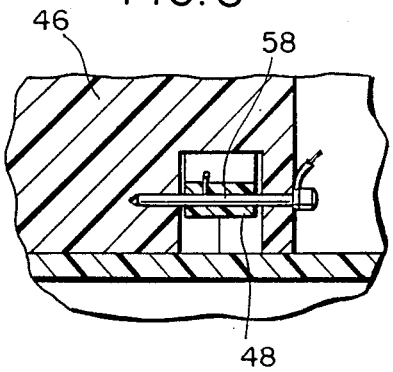
FIG. 8 is an enlarged partial section view taken substantially through a plane indicated by section line 8—8 in FIG. 4.

It will be apparent that simultaneous actuation of both sensor arms 48 and 50 is effected by the inflow of fluent material into the housing chamber 32 thereby exerting buoyant forces on the float elements 54 and 56 attached to the ends of the sensor arms 48 and 50. The fluent material enters the housing adjacent the closure 20 through a screened inlet opening 82 as more clearly seen in FIG. 7. Such inlet opening 82 is aligned with a predetermined level line 84 shown in FIGS. 2 and 10, below which there is no inflow of fluent material into the housing. Accordingly, a back-up condition reflected by fluent material rising to the level denoted by line 84, is detected by the alarm assembly. According to one embodiment, the predetermined level line 84 corresponds to rise of back-up fluid three quarters within the clean-out opening section 14. Such level is regulated by an airhole opening 85 in the wall of housing 18 as shown in FIG. 5. The opening 85 may have a 1/32 inch diameter dimension to permit escape of air from the housing as rising water entering the alarm assembly approaches the regulated level.

Figure 6:
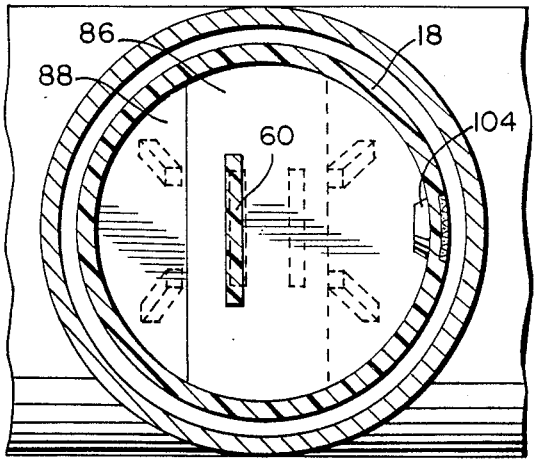
FIG. 6 is a transverse section view taken substantially through a plane indicated by section line 6—6 in FIG. 2.
Figure 9:
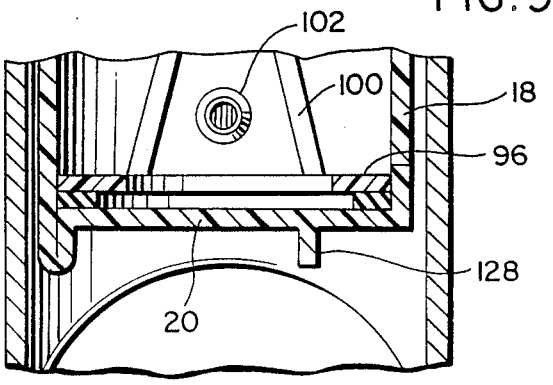
FIG. 9 is a partial section view taken substantially through a plane indicated by section line 9—9 in FIG. 2.

The baffle assembly 38 aforementioned, prevents impact of the back-up material with the sensor arms as a result of its inflow into the housing. The baffle assembly 38 includes a baffle plate 86 blocking axial flow except for a cutout sector 88 to which inflow is limited at a region above the predetermined level line 84 behind the support structure 46. A second baffle plate 90 is axially spaced from baffle plate 86 and in fixed relation thereto by means of connectors 92. The baffle plate 90 limits inflow to a cutout sector 94 angularly spaced by 180° from the flow sector 88 associated with baffle plate 86. Accordingly, the fluent back-up material entering the chamber through inlet opening 82 travels along a tortuous path before it enters the portion of the housing chamber occupied by the sensor assembly 40. The baffle assembly 38 is fixedly positioned in spaced relationship to the sealing closure 20 at one end of the housing by means of spacing support structure 94 as shown in FIGS. 2, 6 and 9. The spacing support 94 includes an annular rim portion 96 seated on the annular sealing element 36. A pair of support arms 98 project from the annular portion 96 in angularly spaced relationship to each other for engagement with and support of the baffle plate 90. A second pair of support arms 100 of somewhat longer dimension, project from the annular rim portion 96 for engagement with and support of the baffle plate 86.

A pair of one-way drain outlets 102 and 104 are mounted on the housing in 180° angular relationship to the inlet opening 82. Each drain opening includes a tapered outlet passage within which a tapered cork-like element 106 is disposed as more clearly seen in FIG. 7. An outlet screen 108 is also mounted on the outer side of the outlet. It will be apparent that the element 106 will block inflow of fluent material into the housing but will be displaced by the fluent material already in the housing so as to open the outlet for draining of such fluent material. The one way outlet 102 will drain the housing within the zone occupied by the baffle assembly 38 while the one way outlet 104 will drain the housing chamber in the zone occupied by the sensor assembly 40. Both of the one way outlets 102 and 104 are located below the predetermined back-up level line 84 for the installation shown in FIG. 10 in order to promptly drain the housing when the back-up material begins to recede from the predetermined level line 84.

Figure 11:
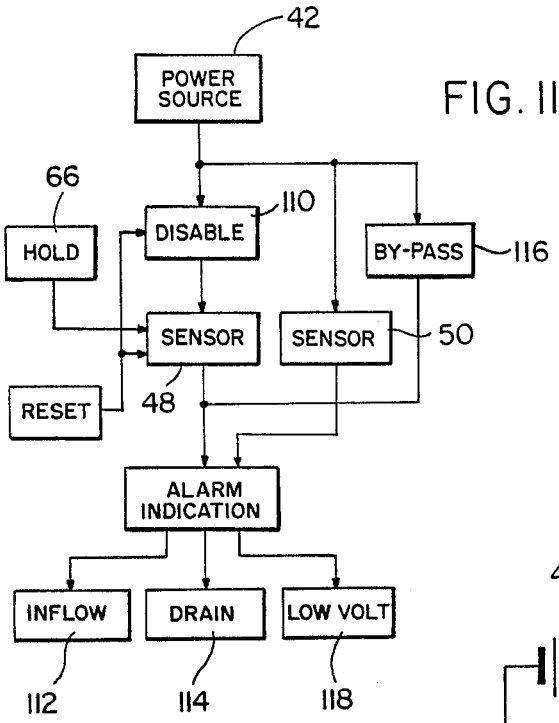
FIG. 11 is a block diagram depicting the alarm control system of the present invention.

FIG. 11 diagrammatically illustrates the alarm system associated with the alarm assembly. As shown in FIG. 11, the power source 42 is operative through the sensor 50 to energize the buzzer 24 and lamp 26. The sensor 48 independently energizes the buzzer and lamp through a disable control 110. When actuated, the sensor 48 is maintained actuated by the holding action of magnet 66 as aforementioned. The sensor 48 is, however, displaced out of the influence of the magnetic holding action of magnet 66 by the reset control 28 as hereinbefore described and diagrammatically illustrated in FIG. 11. Such reset control 28 also interrupts the supply of voltage to the sensor 48 through disable control 110 as diagrammed in FIG. 11. Thus, simultaneous detection of the inflow of the fluent material into the alarm device housing by the sensors 48 and 50 is operative through the alarm indicators 24 and 26 to signify the onset of back-up inflow. When back-up begins to recede, and the fluent material drains from the housing, sensor 50 returns to its limit position under the bias of gravity while the sensor 48 is maintained actuated by the magnetic holding action as aforementioned. Thus, continued actuation of the sensor 48 alone signifies a back-up draining condition 114 as diagrammed in FIG. 11. By means of a selective bypass control 116, with which the actuator switch 30 is associated, the power source is connected to the alarm indicators in bypass relation to the sensors in order to provide a third condition indication 118 when the power source is in a low voltage condition.

Figure 12:
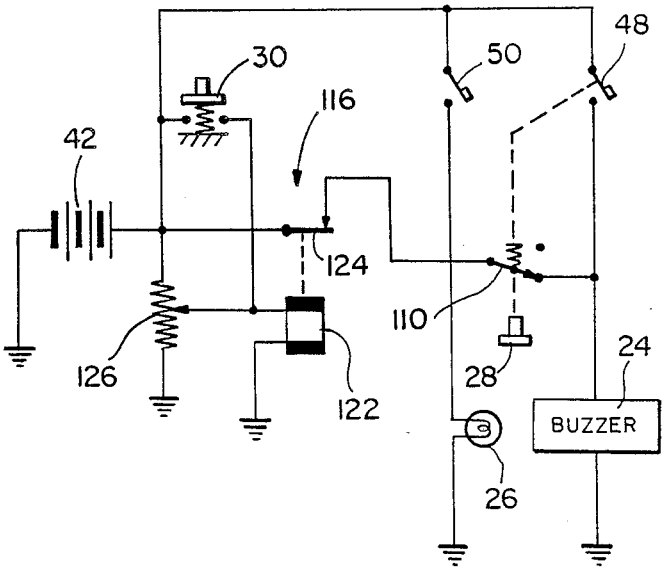
FIG. 12 is an electrical circuit diagram corresponding to the control system depicted in FIG. 11.

According to one embodiment of the invention as illustrated in FIG. 12, the battery power source 42 is electrically connected to the sensors 48 and 50 in parallel. When actuated, the sensor 48 will complete a circuit through the buzzer 24 while the sensor 50 will complete a circuit through the indicator lamp 26. Thus, simultaneous actuation of the sensors 48 and 50 energize both the buzzer 24 and lamp 26 to provide the inflow condition indication aforementioned. When the back-up material recedes, the electrical path established by the sensor 50 is opened to thereby extinguish the indicator lamp 26. The buzzer 24, however, remains energized under the magnetic holding action. The continued operation of the buzzer alone, thereby provides the drain indication aforementioned. Actuation of the reset control 28 opens the circuit completed through the sensor 48 by displacement thereof from its actuated position out of the influence of the magnetic holding action. Actuation of the reset control 28 also displaces the disable control switch 110 to an open position against a spring bias in order to ensure the de-energization of the buzzer 24.

Momentary actuation of the switch 30 against its spring bias as shown in FIG. 12, completes an energizing circuit through a relay coil 122 associated with the bypass control 116 aforementioned in connection with FIG. 11. Such energization of the relay coil 122 opens a normally closed relay switch 124 connected to the battery source 42. The relay coil 122 is also connected to the battery source 42 through an adjustable resistor 126 through which sufficient voltage is maintained across the relay coil to hold the relay switch 124 open after it is actuated from its normally closed position. Accordingly, the relay switch 124 remains open to prevent energization of the buzzer 24 with switch 110 in its closed position. When the voltage of the battery source 42 drops below a predetermined operating level, the reduced holding voltage applied across the relay coil 122 through adjustable resistor 126 becomes insufficient to hold the relay switch 124 open. The relay switch 124 will then close in order to complete an energizing circuit through the buzzer 24 in order to indicate the low voltage condition as aforementioned. The low voltage indicating circuit established through relay switch 124 and switch 110 bypasses the sensor devices 48 and 50 as observed from FIG. 12.

Figure 13:
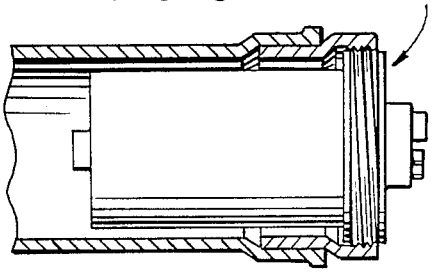
FIG. 13 is a side section view showing installation of the alarm assembly in a test position different from that of FIG. 10.
Figure 14:
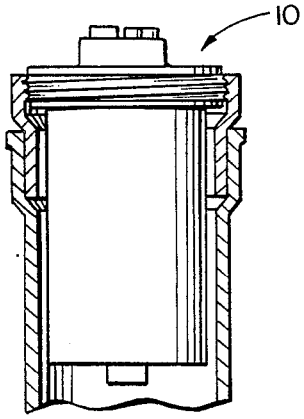
FIG. 14 is a side section view showing placement of the alarm assembly in a position from which it may be removed and reset for operation in any operational mode corresponding to different test positions.

The alarm assembly may be tested by installation in a level position as shown in FIG. 13 and in an upright position as shown in FIG. 14. Further, the alarm assembly may be serviced by opening of the closure 20 provided with a knob 128 for such purpose as shown in detail in FIGS. 2 and 9. With the closure 20 opened, the baffle assembly 38 may be removed for cleaning or replacement purposes while exposing the sensor assembly 40 for cleaning in position within the housing chamber.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. In an alarm assembly adapted to be installed in a clean-out opening of a sewer conduit having a clean-out access cap, a housing extending therefrom into which fluent back-up material rises from the sewer conduit, sensor means for detecting the fluent material above a predetermined back-up level within housing, indicator means triggered into operation in response to said detection of the fluent material by the sensor means and baffle means within the housing for protectively isolating the sensor means from impact by the fluent back-up material during inflow thereof into the housing, said housing enclosing a chamber extending axially from the access cap, closure means connected to the housing for sealing the chamber in axially spaced relation to the access cap and spacer means in abutment with the closure means for supporting the sensor means and the baffle means within the chamber in spaced relation to the closure means, said housing having inlet means for receiving said inflow of the fluent back-up material into the housing and outlet means for draining the fluent back-up material from the housing in response to receding thereof below said predetermined level.

2. The combination of claim 1 including resettable alerting means rendered operative by the sensor means for generating a signal simultaneously with and independently of said operation of the indicator means to respectively signify said rise above and said receding of the fluent material from the predetermined level.

3. The combination of claim 2 wherein said sensor means includes separate level sensing devices respectively connected to the indicator means and the resettable alerting means and magnetic means positioned in operative relation to one of the level sensing devices for maintaining thereof actuated.

4. The combination of claim 3 including manually operable reset means operatively connected to said one of the level sensing devices for disabling of the resettable alerting means.

5. The combination of claim 4 including power means connected to the alerting means through the sensor means for energization and means responsive to energy depletion of the power means for operation of the alerting means in by-pass relation to the sensor means to signify a low voltage condition of the power means.

6. The combination of claim 5 wherein the power means includes a battery source of voltage and relay means operatively connecting the source of voltage to the alerting means under said low voltage condition in by-pass relation to the sensor means.

7. In an alarm assembly adapted to be installed in a clean-out opening of a sewer conduit having a clean-out access cap, a housing extending therefrom into which fluent back-up material rises from the sewer conduit, sensor means for detecting the fluent material above a predetermined back-up level within housing, indicator means triggered into operation in response to said detection of the fluent material by the sensor means, resettable alerting means rendered operative by the sensor means for generating a signal simultaneously with and independently of said operation of the indicator means to respectively signify rise above and receding of the fluent material from the predetermined level.

8. In an alarm assembly adapted to be installed in a clean-out opening of a sewer conduit having a clean-out access cap, a housing extending therefrom into which fluent back-up material rises from the sewer conduit, sensor means for detecting the fluent material above a predetermined back-up level within housing, indicator means triggered into operation in response to said detection of the fluent material by the sensor means, power means connected to the alerting means through the sensor means for energization and means responsive to energy depletion of the power means for operation of the alerting means in by-pass relation to the sensor means to signify a low voltage condition of the power means.

9. The combination of claim 8 wherein the power means includes a battery source of voltage and relay means operatively connecting the source of voltage to the alerting means under said low voltage condition in by-pass relation to the sensor means.

10. The combination of claim 7 wherein said sensor means includes separate level sensing devices respectively connected to the indicator means and the resettable alerting means and magnetic means positioned in operative relation to one of the level sensing devices for maintaining the resettable alerting means in operation when actuated by said one of the level sensing devices.

11. In combination with an alarm system having an elongated housing enclosing a chamber adapted to receive an inflow of fluent material, sensor means within the housing for detecting inflow of the fluent material, alerting means operatively connected to the sensor means for operation in response to said detection of the inflow by the sensor means, said alerting means including an indicator operated in response to said inflow of the fluent material and draining thereof from the housing, and resettable means rendered operative through the sensor means for generating an alerting signal simultaneously with and independently of said operation of the indicator to respectively signify said inflow and said draining of the fluent material.

12. The combination of claim 11 wherein said sensor means includes separate level sensing devices respectively connected to the indicator and the resettable means and magnetic means positioned in operative relation to one of the level sensing devices for maintaining the resettable means in operation when actuated by said one of the level sensing devices.

13. The combination of claim 11 including power means connected to the resettable means through the sensor means for energization thereof during said operation of the indicator and means responsive to energy depletion of the power means for energization of the resettable means in by-pass relation to the sensor means to signify a low voltage condition of the power means.

14. In combination with an alarm system having an elongated housing enclosing a chamber adapted to receive an inflow of fluent material, sensor means within the housing for detecting inflow of the fluent material, alerting means operatively connected to the sensor means for operation in response to said detection of the inflow by the sensor means, power means connected to the alerting means through the sensor means for energization thereof during said operation thereof and means responsive to energy depletion of the power means for energization of the alerting means in by-pass relation to the sensor means to signify a low voltage condition of the power means.

15. In combination with an alarm system having an elongated housing enclosing a chamber adapted to receive an inflow of fluent material, sensor means within the housing for detecting inflow of the fluent material, alerting means operatively connected to the sensor means for operation in response to said detection of the inflow by the sensor means, said sensor means including separate level sensing devices operatively connected to the alerting means and magnetic means positioned in operative relation to one of the level sensing devices for maintaining the alerting means in operation when actuated by said one of the level sensing devices.

16. In combination with a sewer back-up alarm having an elongated housing enclosing a chamber adapted to receive an inflow of fluent material, said alarm including sensor means within the housing for detecting inflow of the fluent material, indicator means operatively connected to the sensor means for operation in response to said detection of the inflow by the sensor means and draining of the fluent material from the housing, and resettable alerting means rendered operative through the sensor means for generating an alerting signal simultaneously with and independently of said operation of the indicator means to respectively signify said inflow and said draining of the fluent material.

17. The combination of claim 16 wherein said sensor means includes separate level sensing devices respectively connected to the indicator means and the resettable alerting means and magnetic means positioned in operative relation to one of the level sensing devices for maintaining the resettable alerting means in operation when actuated by said one of the level sensing devices.

18. The combination of claim 16 including power means connected to the alerting means through the sensor means for energization thereof during said operation thereof and means responsive to energy depletion of the power means for energization of the alerting means in by-pass relation to the sensor means to signify a low voltage condition of the power means.

19. In an alarm system having an enclosure receiving an inflow of fluent material, at least two independently actuatable sensing devices for simultaneously detecting said inflow of the fluent material, holding means responsive to actuation of only one of the sensing devices for maintaining the same actuated while the fluent material recedes from the enclosure and alerting means operatively connected to the sensing devices for indicating said receding of the fluent material from the enclosure in response to the continued actuation of said one of the sensing devices.

20. The system as defined in claim 19 wherein said holding means includes means for establishing a limited zone within which said one of the sensing devices is magnetically held actuated.

21. The system as defined in claim 20 including reset means operatively engageable with said one of the sensing devices for displacement thereof from said limited zone and switch means responsive to the displacement of said one of the sensing devices for disabling the alerting means.

22. The system as defined in claim 21 including operating voltage means connected to the sensing devices for energization of the alerting means therethrough and selectively controlled relay means operatively connecting the voltage means to the alerting means in by-pass relation to the sensing devices for indicating a low voltage condition of the voltage means.

23. The system as defined in claim 19 including operating voltage means connected to the sensing devices for energization of the alerting means therethrough and selectively controlled relay means operatively connecting the voltage means to the alerting means in by-pass relation to the sensing devices for indicating a low voltage condition of the voltage means.

* * * * *